US005761833A

United States Patent [19]

McMullin

[11] Patent Number: 5,761,833

[45] Date of Patent: Jun. 9, 1998

[54] ATHLETIC SHOE TRACTION SYSTEM FOR USE ON TURF

[75] Inventor: Faris W. McMullin, Boise, Id.

[73] Assignee: Softspikes, Inc., Rockville, Md.

[21] Appl. No.: 803,819

[22] Filed: Feb. 24, 1997

Related U.S. Application Data

[62] Division of Ser. No. 576,903, Dec. 22, 1995, abandoned.

[60] Provisional application No. 60/005,116, Oct. 12, 1995.

[51] Int. Cl.[6] ..... A43C 15/02; A43C 13/04

[52] U.S. Cl. ..... 36/67 D; 36/62; 36/134

[58] Field of Search ..... 36/15, 62, 67 D, 36/100, 101, 134, 135

[56] References Cited

U.S. PATENT DOCUMENTS

| | | | |
|---|---|---|---|
| 39,575 | 8/1863 | Hyatt et al. . | |
| 217,969 | 7/1879 | Willson | 36/67 D |
| D. 320,882 | 10/1991 | Collins | D2/314 |
| D. 327,975 | 7/1992 | Saito et al. | D2/314 |
| D. 341,479 | 11/1993 | Saito et al. | D2/314 |
| D. 341,480 | 11/1993 | Saito et al. | D2/317 |
| D. 341,704 | 11/1993 | Saito et al. | D2/962 |
| D. 341,705 | 11/1993 | Saito et al. | D2/962 |
| D. 341,938 | 12/1993 | Saito et al. | D2/962 |
| D. 342,151 | 12/1993 | Saito et al. | D2/962 |
| D. 342,152 | 12/1993 | Saito et al. | D2/962 |
| D. 342,373 | 12/1993 | Saito et al. | D2/962 |
| 485,459 | 11/1892 | Crocker . | |
| 962,719 | 6/1910 | Pratt . | |
| 982,278 | 1/1911 | Kline . | |
| 1,876,195 | 9/1932 | Youmans . | |
| 2,491,596 | 12/1949 | Zaleski et al. | 36/59 |
| 2,745,197 | 5/1956 | Holt | 36/2.5 |
| 2,776,499 | 1/1957 | Giuntini | 36/135 |
| 3,487,563 | 1/1970 | Austin | 36/67 |
| 3,512,275 | 5/1970 | Leavitt | 36/59 |
| 3,559,310 | 2/1971 | Kiela | 36/7.3 |
| 3,561,140 | 2/1971 | Ludwig et al. | 36/59 |
| 3,583,082 | 6/1971 | Jordan, Jr. | 36/59 |
| 3,583,083 | 6/1971 | Drew | 36/62 |
| 3,656,245 | 4/1972 | Wilson | 36/67 D |
| 3,672,077 | 6/1972 | Coles | 36/2.5 T |
| 3,747,238 | 7/1973 | Jankauskas | 36/61 |

(List continued on next page.)

FOREIGN PATENT DOCUMENTS

| | | |
|---|---|---|
| 0 153 136 | 8/1985 | European Pat. Off. . |
| 0 524 861 | 1/1993 | European Pat. Off. . |
| 493748 | 8/1919 | France . |
| 807754 | 1/1937 | France . |
| 185659 | 6/1907 | Germany . |
| 156642 | 7/1939 | Germany . |
| 2529027 | 1/1977 | Germany . |
| 4316650 | 11/1993 | Germany . |
| 467815 | 12/1951 | Italy . |
| 7-209 | 1/1995 | Japan . |
| 6877 | 2/1896 | United Kingdom . |
| 401979 | 11/1933 | United Kingdom . |
| 1 263 960 | 2/1972 | United Kingdom . |
| 1378461 | 12/1974 | United Kingdom . |
| 1434282 | 5/1976 | United Kingdom . |
| 2 053 658 | 2/1981 | United Kingdom . |
| 2223394 | 4/1990 | United Kingdom . |
| 2266223 | 10/1993 | United Kingdom . |
| 91/03960 | 4/1991 | WIPO . |

*Primary Examiner*—Paul T. Sewell
*Assistant Examiner*—Anthony Stashick
*Attorney, Agent, or Firm*—Fish & Neave; Jeffrey H. Ingerman

[57] ABSTRACT

An athletic shoe traction system which uses a plurality of miniature spikes is provided. The miniature spikes are preferably removably mounted so that they can be replaced when worn out. The miniature spikes can be formed on removable cleats similar to conventional removable cleats, or they can be provided on pads that attach to the underside of an athletic shoe, preferably in a recess provided for that purpose. Hook-and-loop type fasteners or other releasable fasteners, such as a releasable adhesive, can be used to attach the pads.

2 Claims, 11 Drawing Sheets

U.S. PATENT DOCUMENTS

| | | | |
|---|---|---|---|
| 3,818,617 | 6/1974 | Dassler et al. | 36/32 R |
| 3,890,725 | 6/1975 | Lea et al. | 36/11.5 |
| 3,982,336 | 9/1976 | Herro | 36/15 |
| 4,004,356 | 1/1977 | Green | 36/134 |
| 4,014,114 | 3/1977 | Jordan et al. | 36/67 D |
| 4,141,158 | 2/1979 | Benseler et al. | 36/32 R |
| 4,180,923 | 1/1980 | Dassler | 36/32 R |
| 4,205,466 | 6/1980 | Collins | 36/67 D |
| 4,233,759 | 11/1980 | Bente et al. | 36/59 R |
| 4,294,024 | 10/1981 | Nab | 36/113 |
| 4,309,376 | 1/1982 | Ueno et al. | 264/241 |
| 4,330,950 | 5/1982 | Reddien | 36/127 |
| 4,392,312 | 7/1983 | Crowley et al. | 36/67 R |
| 4,492,047 | 1/1985 | Arff | 36/134 |
| 4,527,345 | 7/1985 | Lopez Lopez | 36/127 |
| 4,571,852 | 2/1986 | Lamarche et al. | 36/32 R |
| 4,587,748 | 5/1986 | Collins | 36/127 |
| 4,633,600 | 1/1987 | Dassler et al. | 36/134 |
| 4,689,901 | 9/1987 | Ihlenburg | 36/126 |
| 4,723,366 | 2/1988 | Hagger | 36/134 |
| 4,727,661 | 3/1988 | Kuhn | 36/100 |
| 4,777,738 | 10/1988 | Giese et al. | 36/32 R |
| 4,782,604 | 11/1988 | Wen-Shown | 36/127 |
| 4,833,796 | 5/1989 | Flemming | 36/134 |
| 4,837,949 | 6/1989 | Dufour | 36/127 |
| 4,885,851 | 12/1989 | Peterson | 36/127 |
| 5,033,211 | 7/1991 | Latraverse et al. | 36/134 |
| 5,070,631 | 12/1991 | Fenton | 36/127 |
| 5,077,916 | 1/1992 | Beneteau | 36/114 |
| 5,259,129 | 11/1993 | Deacon et al. | 36/127 |
| 5,367,793 | 11/1994 | Deacon et al. | 36/127 |
| 5,483,760 | 1/1996 | Kataoka et al. | 36/134 |

ATHLETIC SHOE TRACTION SYSTEM FOR USE ON TURF

CROSS REFERENCE TO RELATED APPLICATIONS

This is a division of commonly-assigned U.S. patent application Ser. No. 08/576,903, filed Dec. 22, 1995, now abandoned which claims the benefit of U.S. Provisional Application No. 60/005,116, filed Oct. 12, 1995.

BACKGROUND OF THE INVENTION

This invention relates to athletic shoes for use on turf, and particularly to a traction system to enhance traction for the wearer without adversely affecting the turf.

The need for improved traction on turf surfaces is well known. Specialized shoes for many different sports—e.g., baseball, football, soccer and golf, among others—have structure provided on their soles to enhance traction. Taking golf as a representative example throughout the remainder of this specification, it has long been known to provide golf shoes with relatively large metal spikes for traction.

For almost as long as they have been in use, golf spikes (and similar structures provided on athletic shoes for other turf sports) have also been known to adversely affect the turf of golf courses (or other playing surfaces), and particularly putting greens. The large spikes tear into the putting green surface, particularly when a golfer drags his or her feet as many do, leaving "spike marks" that disrupt the carefully manicured surface and adversely affect the trajectories of putted golf balls. So well known are spike marks in golf that the rules of the game have been adapted to account for their presence (the rules prohibit repairing spike marks before putting). In addition to affecting players' putting, spike marks also affect groundskeepers, who after a day of play by numerous spike-wearing golfers have to spend hours repairing the various putting greens on their golf courses.

In addition to the annoyance to players and groundskeepers caused by the marks that they leave, traditional golf shoe spikes also affect the health of grass all over the golf course, not only on greens. First, the spikes penetrate a significant distance into the ground, frequently damaging a portion of the grass plant above the roots, known as the "crown." Damage to the crown often kills the plant. Second, the spikes pick up seeds of undesirable plants—including weeds and grasses (e.g., *Poa annua*)—and inoculate those seeds into the greens, causing growth of undesirable plants.

Traditional metal golf spikes are also damaging to the floor surfaces of golf clubhouses, and may actually exacerbate slipping on certain clubhouse floor surfaces such as marble. Traditional metal golf spikes even cause damage to paved outdoor walkways.

One known solution to the problems caused by traditional golf spikes is shown in commonly-assigned U.S. Pat. Nos. 5,259,129 and 5,367,793, which are hereby incorporated by reference in their entirety. Those patents show a golf cleat that attaches to the same golf shoe fittings designed for traditional spikes. The cleat is preferably made from a plastic material having a preferably convex lower surface bearing a plurality of ribs that distribute the golfer's weight to produce a plurality of gripping forces—which are mainly frictional—in a plurality of directions, without puncturing the turf, thereby reducing the adverse affects described above.

However, the cleats of the aforementioned patents do not completely solve the problem of providing traction without damaging turf. First, the cleats still cause indentations in the grass surface of the turf—particularly on putting greens—that may take a not insignificant time to spring back. Second, the cleats may not provide on all surfaces traction approximating that provided by traditional golf spikes. That is particularly the case with wet turf surfaces as well as steep slopes. Third, because of the material from which they are made and the fact that they protrude from the sole of the shoe, the cleats may be dislodged from the shoe if they catch on obstructions.

In addition, while the cleats of the aforementioned patents are less damaging than traditional metal golf spikes to clubhouse floors and walkways, they do not eliminate such damage completely, and they may still slip on some floor surfaces.

It would be desirable to be able to provide a system for providing traction in golf shoes (and shoes for other turf sports) that does not adversely affect turf, but provides a desired level of traction under as many different conditions as possible.

It would also be desirable to be able to provide such a traction system that is resistant to being dislodged from the shoe with which it is used.

It would further be desirable to be able to provide such a traction system that is less damaging to pavement and flooring.

SUMMARY OF THE INVENTION

It is an object of the present invention to provide a system for providing traction in golf shoes (and shoes for other turf sports) that does not adversely affect turf, but provides a desired level of traction under as many different conditions as possible.

It is also an object of the present invention to provide such a traction system that is resistant to being dislodged from the shoe with which it is used.

It is a further object of the present invention to provide such a traction system that is less damaging to pavement and flooring.

In accordance with this invention, there is provided an athletic shoe for providing traction on turf surfaces. The athletic shoe includes a sole, a heel, and a plurality of protrusions extending from at least one of (a) a significant area of the sole and (b) a significant area of the heel. Each of the protrusions has a height sufficient to engage blades of grass in the turf to provide traction substantially without puncturing the turf. The protrusions are spaced apart by a separation distance sufficient to prevent clogging of space between the protrusions with debris from the turf.

By "substantially without puncturing the turf" is meant that the protrusions extend into and engage the grass blades of the turf, but do not penetrate ink the ground or, if they do penetrate into the ground on certain types of turf surfaces (such as closely cropped greens), penetrate into the ground only a negligible amount insufficient to significantly damage the grass plant.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
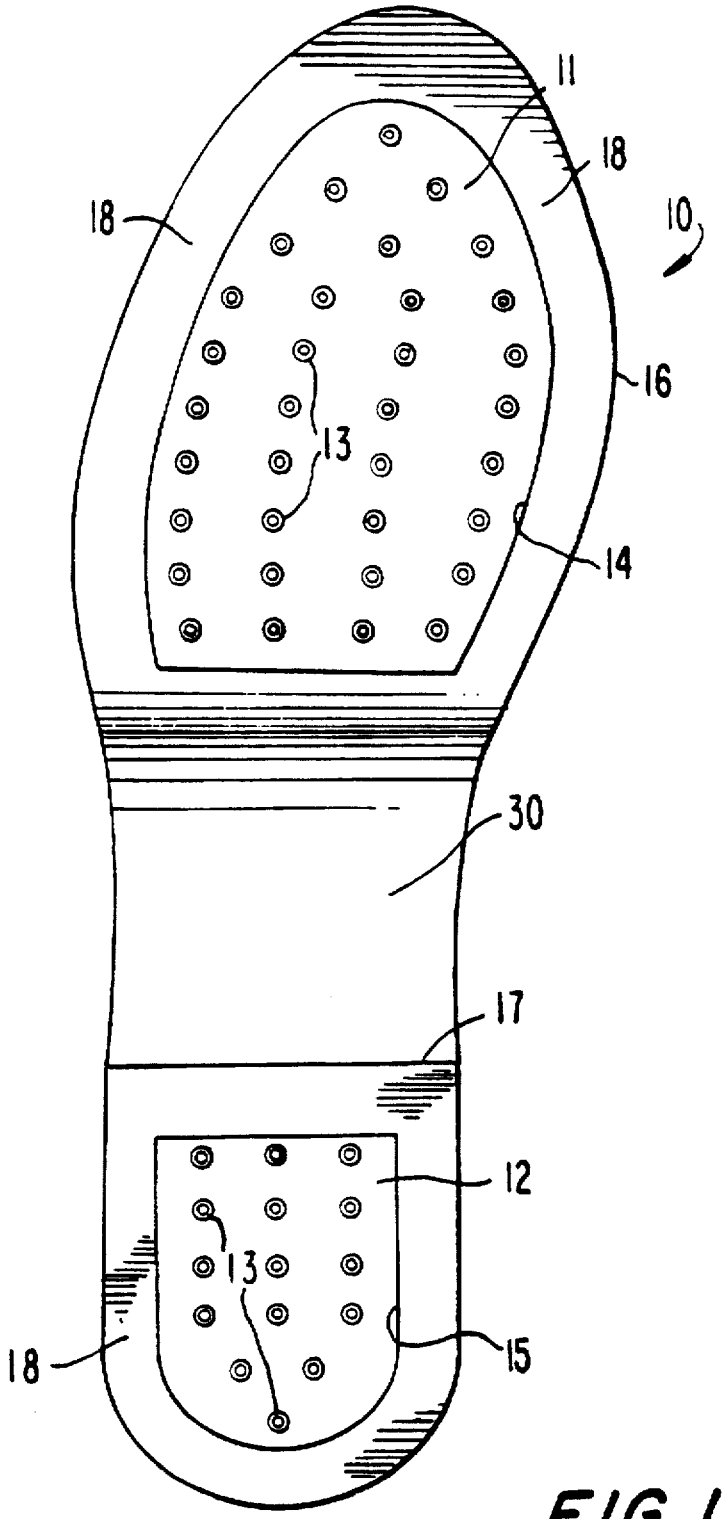
FIG. 1 is a plan view of the underside of an athletic shoe incorporating a first preferred embodiment of the present invention, showing the sole and heel.

In accordance with the present invention, traction is provided for athletic activities on turf surfaces by providing an athletic shoe having areas with a relatively large number of relatively small protuberances. In one embodiment, for example, a large portion of the sole and heel has a relatively large number of relatively small protuberances. Thus, in place of ten or twelve relatively large metal golf spikes on a golf shoe, there would be a large number—(e.g., about 35 to about 200, and preferably about 100 to about 200)—of relatively small protuberances, which may be referred to as miniature spikes. The miniature spikes of the present invention provide traction by physical interengagement with the grass blades of the turf surface, but they have a low profile so that they do not penetrate the ground or, if they do penetrate, they penetrate only a negligible amount. Therefore, they provide better traction than the cleats described in the aforementioned commonly-assigned patents, but they do not cause the damage associated with traditional large metal spikes.

The miniature spikes of the present invention are relatively close together on the bottom surfaces of the athletic shoe. However, if they are too close together, the spaces between them may become clogged with dirt and bits of grass, reducing the traction provided. Therefore, the miniature spikes must be spaced far enough apart to avoid clogging. Moreover, if they are too close together, the miniature spikes may act as a single mass, indenting the grass surface of the turf without mechanically engaging the grass blades, and thus without providing traction. It has been found that the miniature spikes should be spaced apart by a distance between about two times and about four times the height of each miniature spike; the height is chosen to allow engagement with the grass blades to achieve traction, without penetrating the ground. In one preferred embodiment, the height of each miniature spike is about 0.08 inch (about 2.0 mm), and the spacing between miniature spikes is about 0.25 inch (about 6.35 mm). Another way of quantifying the separation between miniature spikes is by their density; for a miniature spike height of about 0.08 inch (about 2.0 mm), preferably there are between about three miniature spikes per square inch and about twenty-five miniature spikes per square inch (between about 0.47 miniature spikes per square centimeter and about 3.88 miniature spikes per square centimeter), and more preferably between about seven miniature spikes per square inch and about twenty-five miniature spikes per square inch (between about 1.09 miniature spikes per square centimeter and about 3.88 miniature spikes per square centimeter). In a particularly preferred embodiment for use on golf courses, there are about seventeen miniature spikes per square inch (about 2.64 miniature spikes per square centimeter). In any event, the miniature spikes should be far enough apart to prevent clogging.

In the preferred embodiment for use on golf courses, each miniature spike preferably has a height of about 0.08 inch (about 2.0 mm). To achieve sufficient column stiffness, thereby preventing the miniature spikes from bending, the width of the base of each miniature spike is preferably about the same as the height of the miniature spike.

The width of each miniature spike preferably varies as one moves along its height, most preferably decreasing continuously from the base toward the tip. The most particularly preferred shape for the miniature spike is a truncated cone having a base and height of about 0.08 inch (about 2.0 mm) and a flat circular tip having a diameter of about 0.05 inch (about 1.27 mm). The miniature spike preferably should not come to a point, because a pointed miniature spike would wear faster than one with a blunt tip. For that reason, as well as to avoid tearing the grass blades, and to avoid injury if a wearer were to accidentally brush his skin or that of another with the tips of the miniature spikes, it is also particularly preferred, though not essential, that the miniature spikes not be made of metal. A preferred material is a resilient polymeric material; a particularly preferred resilient polymeric material is polyurethane. However, any resilient polymeric material can be used that has sufficient abrasion resistance to survive more than a small number of wearings.

A preferred configuration for the miniature spikes is to provide large areas on the sole and heel of the shoe that are covered with the miniature spikes. The miniature spikes preferably are not molded directly into the sole or heel, because while they should preferably be sufficiently abrasion resistant to be used for at least several instances of the athletic event for which they are designed (e.g., several rounds of golf), they also should not be so hard as to damage the turf; therefore, they eventually will wear out and require replacement. Accordingly, the miniature spikes should be provided in a way that they can be removed and replaced by the wearer when necessary.

In one such preferred system, the miniature spikes are provided on a first mat or pad that covers most of the sole of the shoe (except at the arch, where the miniature spikes normally would not touch the ground and therefore would provide no advantage, although providing miniature spikes at the arch is not harmful, nor is it contrary to the principles of the invention), and a second mat or pad that covers most of the heel of the shoe. The pads are preferably attached to the shoe by a releasable fastener, most preferably hook-and-loop-type fasteners (commonly referred to as VELCRO®), with the hook portion preferably attached to the shoe and the loop portion preferably on the removable, replaceable pad. When the miniature spikes wear out, the wearer simply separates the hook-and-loop-type fasteners, removes the pad, and applies a new pad.

To prevent the edges of the pads from being dislodged by obstructions on the ground, recesses are preferably provided in the sole and in the heel, and the pads preferably are received in the recesses. The depth of each recess is preferably about equal to the sum of the thicknesses of both layers of the hook-and-loop-type fasteners, as well as the thickness of the mat or pad-itself (exclusive of the miniature spikes), so that the surface of the mat or pad from which the spikes protrude is flush with the sole or heel. In that way, the probability that the edge of the pad will be caught on an obstruction is negligible. The provision of such a recess also substantially eliminates any indentation of the grass surface of the turf caused by the thickness of the pad.

Instead of hook-and-loop-type fasteners, the pad could be attached to the sole or heel by a tenacious pressure-sensitive adhesive. When the pad requires replacement, the adhesive can be heated (e.g., with a hand-held hair dryer) to soften it, and the worn pad removed. A new pad with fresh adhesive would be supplied, preferably with a release paper covering the adhesive. The wearer would peel off the release paper to expose the adhesive, and apply the pad to the shoe. This adhesive attachment is particularly preferred where no recess is provided in the sole or heel, because two layers of hook-and-loop-type fasteners plus the pad would result in a substantial thickness protruding from the shoe. However, the adhesive could also be used if there were a recess. Indeed, such an adhesive is the preferred mode of attachment of the hook-and-loop-type fastener material itself, when used, to the shoe.

Alternatively, the pad could be attached to the sole or heel by a mechanical attachment, such as screws (which may require the provision of tapped holes in the shoe) or a detachable fastener such as a bayonet-type or snap-type fastener (with appropriate mating structure on the shoe).

Another preferred system for attaching the miniature spikes to an athletic shoe is to provide them on cleats which are attached to the shoe in the same way as traditional golf spikes or as the cleats described in the aforementioned, commonly-assigned patents. Such cleats according to this embodiment of the invention may have a disk-like flange with the miniature spikes extending from one surface and a threaded shaft extending from the opposite surface, and are particularly useful with existing athletic shoes (particularly golf shoes) that have threaded sockets for receiving the known spikes or cleats. The cleats are preferably molded from the same resilient material referred to above, and the threaded shaft is preferably molded along with the remainder of the cleat, although a metal shaft could be attached to the molded flange. The resilience of the flange increases the resistance of the cleat to being dislodged by obstructions; instead of being dislodged, the cleat will usually deform and then recover its shape when the obstruction has passed.

The flange of the cleat is preferably as thin as possible to minimize indentation of the grass surface of the turf. Preferably, the flange is no thicker than about one half the height of the miniature spikes. In the most preferred embodiment, where the miniature spikes have heights of about 0.08 inch (about 2.0 mm), the flange preferably has a thickness of about 0.04 inch (about 1.0 mm). The thickness of the flange is of less concern when the cleats are used with certain athletic shoes which have recesses into which the cleats-are inserted. The flange is preferably concave on the side facing the sole, flattening out as the cleat is tightened against the sole, to provide a better seal and also to provide a tensioning effect to keep the cleat from loosening.

The invention will now be described with reference to the drawings.

Figure 2:
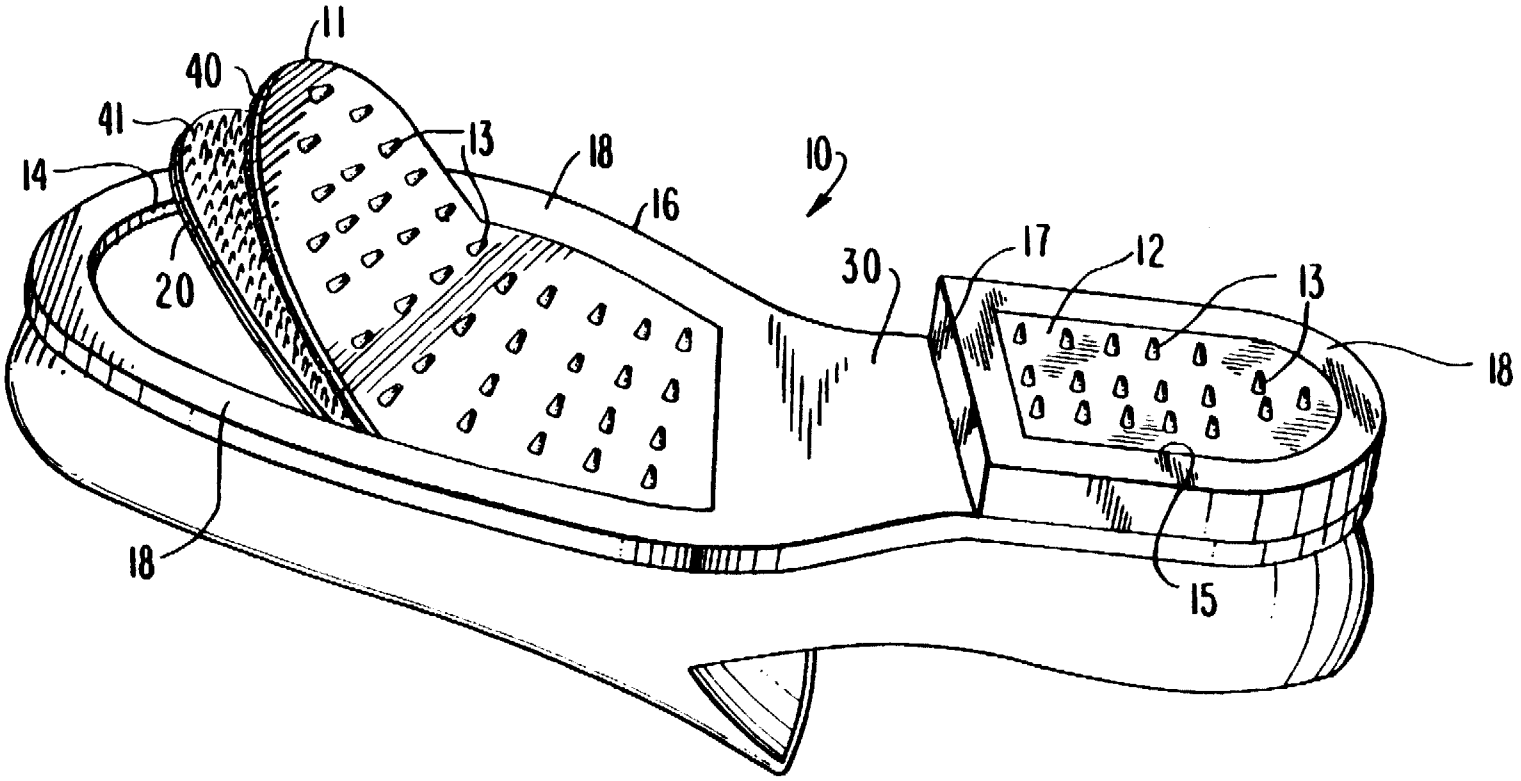
FIG. 2 is a bottom perspective view of the athletic shoe of FIG. 1 in a partially disassembled condition.
Figure 3:
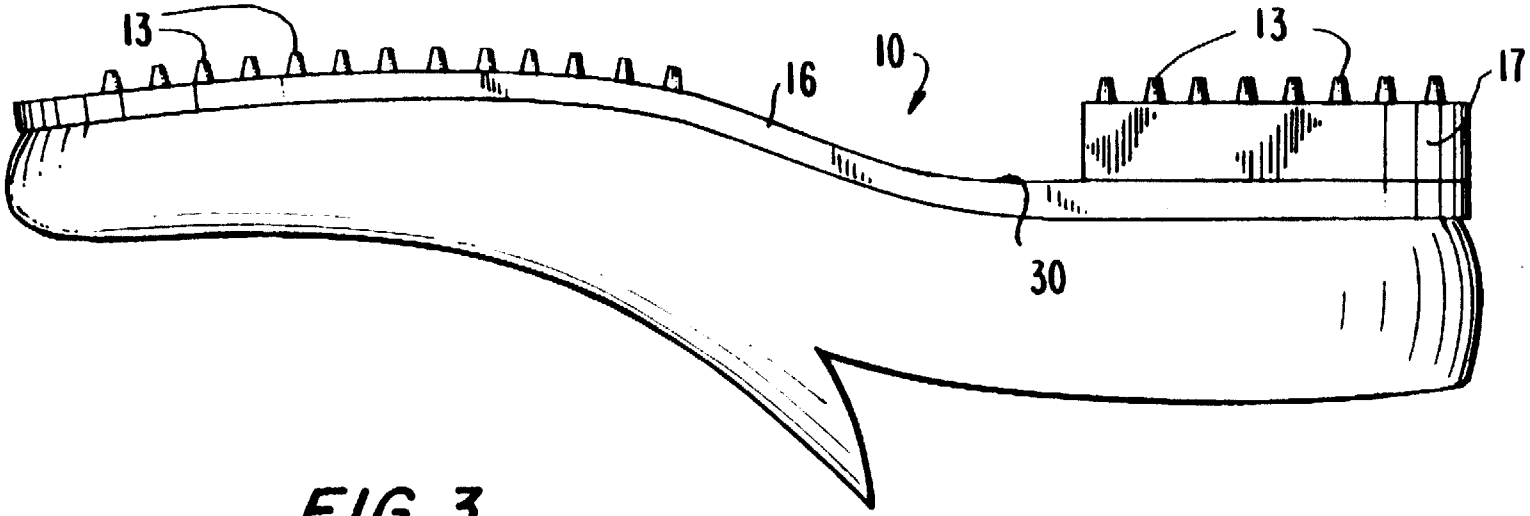
FIG. 3 is a side elevational view of an athletic shoe incorporating the first preferred embodiment of the present invention.
Figure 4:
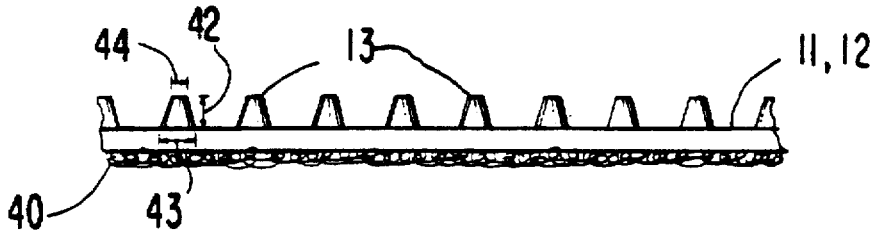
FIG. 4 is an enlarged fragmentary vertical cross-sectional view of a pad or mat according to the first preferred embodiment of the present invention, showing details of the protuberances according to the invention.
Figure 5:
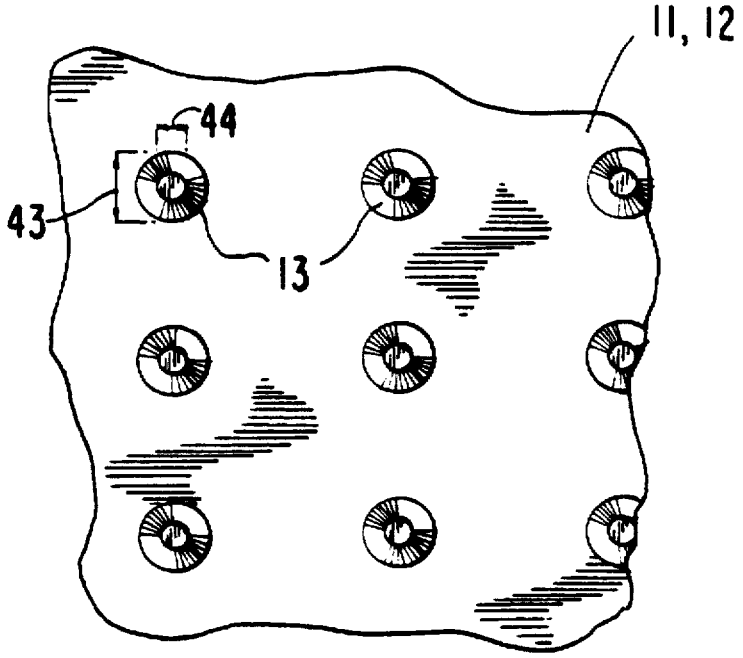
FIG. 5 is an enlarged fragmentary plan view of a pad or mat according to the first preferred embodiment of the present invention, showing details of the protuberances according to the invention.

FIGS. 1–5 show a first preferred embodiment of the present invention in which respective pads 11, 12 bearing miniature spikes 13 according to the invention are affixed within respective recesses 14, 15 in the sole 16 and heel 17 of an athletic shoe 10. As seen in FIGS. 2 and 4, each pad 11, 12 preferably has an array of miniature spikes 13 on one side and a layer of loop portion 40 of hook-and-loop-type fastener material affixed to the other side. Each recess 14, 15 is preferably lined with a layer of complementary hook portion 41 of hook-and-loop-type fastener material. Hook portion 41 preferably is attached to the inner surface of recess 14, 15 by a layer of tenacious heat-and pressure-sensitive adhesive 20. Loop portion 40 is preferably attached to pad 11, 12 by a similar adhesive layer (not shown).

While the hook-and-loop-type fastener portions may be reversed, with the loop portion in recess 14, 15 and the hook portion on the back of pad 11, 12 it is preferred that the portions be located as shown. If the loop portion were the "permanent" portion—i.e., the portion affixed to recess 14, 15—then as pads wore out and were replaced, eventually enough loops would be torn that the hook portion on the pad would not be able to achieve sufficient engagement with the loop portion for a firm attachment. The hook portion is more durable, and more likely to retain its fastening ability, and therefore is preferred as the "permanent" portion. However, whichever fastener portion 40, 41 is attached as the "permanent" portion within recess 14, 15, if it wears out, it preferably can be removed, preferably by heating adhesive layer 20 (e.g., with a hand-held hair dryer) until the adhesive is soft enough for the fastener portion 40, 41 to be removed. A new fastener portion 40, 41 would be provided with adhesive layer 20 built in, preferably covered by a release paper (not shown). The user would peel off the release paper and apply the new fastener portion 40, 41 to the interior of recess 14, 15.

As discussed above, the depth of recess 14, 15 is preferably substantially equal to the sum of the thicknesses of pad 11, 12 and the two hook-and-loop-type fastener portions 40, 41, so that the surface of pad 11, 12 from which miniature spikes 13 protrude, is substantially flush with the surface of sole 16 or heel 17, respectively, as seen in FIG. 3. Therefore, in this embodiment, the thickness of pad 11, 12 is not critical.

The area of sole 16 and heel 17 that is covered with miniature spikes 13 is less than the complete area as shown in FIGS. 1 and 2. One portion of the area that is not covered is the area of arch 30, which does not normally touch the ground. However, although they would rarely if ever provide any traction, miniature spikes 13 could be provided at arch 30 if desired. Another portion of the sole and heel area that may not be covered are the borders 18, which generally define the recesses 14, 15. Recesses 14, 15 need not be provided, in which case pads 11, 12 could extend to the edges of sole 16 and heel 17. However, if recesses 14, 15 are not provided, pads 11, 12 are more likely to be damaged or dislodged in use. Accordingly, it is preferred that such recesses 14, 15 be provided.

As discussed above, miniature spikes 13, as well as pads 11, 12, are preferably molded from a resilient polymeric material having sufficient abrasion resistance to be used for at least several rounds of golf, most preferably polyurethane.

Miniature spikes 13 are preferably long enough to mechanically engage grass blades in the turf surface without penetrating the ground or, on certain types of turf that are not very dense—such as the closely cropped surfaces of golf greens, with only minimal ground penetration. As discussed above, a preferred height 42 for miniature spikes 13 is about 0.08 inch (about 2.0 mm). As also discussed above, the width of each miniature spike 13 preferably varies along its height, preferably decreasing continuously with increasing distance from pad 11, 12. In order to prevent miniature spikes 13 from bending over and becoming ineffective, the width 43 of the base of each miniature spike 13 is preferably about the same as height 42, so that width 43 also is preferably about 0.08 inch (about 2.0 mm). Most preferably, each miniature spike 13 is a truncated cone having a base and a height of about 0.08 inch (about 2.0 mm), and a substantially flat tip having a diameter 44 of about 0.05 inch (about 1.27 mm).

The spacing between miniature spikes 13 is preferably chosen so that the miniature spikes 13 are far enough apart to prevent clogging. Preferably, the distance between miniature spikes 13 should be between about two and about four times the height of miniature spikes 13, more preferably about three times the height of miniature spikes 13. Thus, for miniature spikes 13 with a height of about 0.08 inch (about 2.0 mm), the distance between miniature spikes 13 preferably should be about 0.25 inch (about 6.35 mm).

Figure 6:
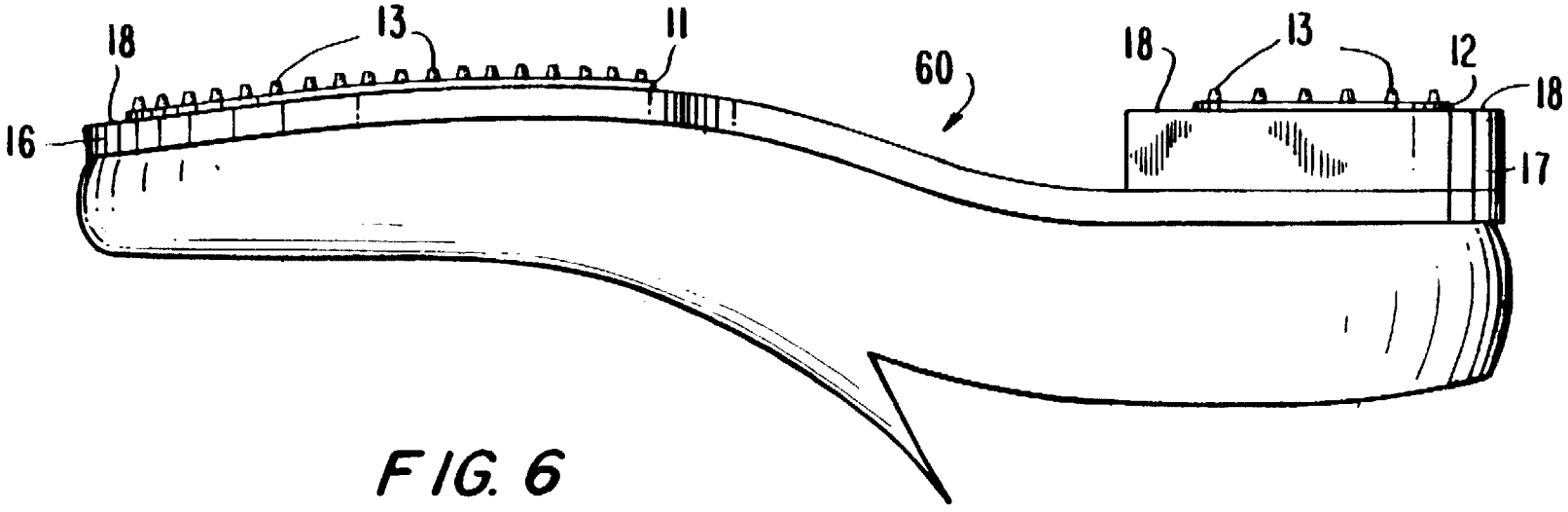
FIG. 6 is a side elevational view, similar to FIG. 3, of an athletic shoe incorporating a second preferred embodiment of the present invention.

In a second preferred embodiment 60 shown in FIG. 6, pads 11 and 12 are affixed to the respective surfaces of sole 16 and heel 17, which are not provided with recesses. Preferably, pad 11, 12 is attached with a heat-sensitive, pressure-sensitive adhesive (not shown) such as adhesive 20 discussed above, so that when pad 11, 12 wears out, it can be removed by heating the adhesive as discussed above. A new pad 11, 12, is preferably provided with adhesive covered by a release layer, as above. The release layer is removed and the new pad 11, 12 is applied. In this embodiment, as shown, borders 18 are maintained. However, there is no reason why pad 11, 12 in this embodiment cannot extend to the edges of sole 16 and heel 17, except possibly that pad 11, 12 may be more likely to be dislodged if its edge extends to the edge of sole 16 or heel 17. In this embodiment, the thickness of pad 11, 12 is of more concern than in first preferred embodiment 10, because it contributes in this embodiment to indenting the grass surface of the turf. Therefore, it is preferred in this embodiment 60 that pad 11, 12 have a thickness of at most about one half the height of miniature spikes 13. Pad 11, 12 is otherwise identical to pad 11, 12 in the first preferred embodiment. Thus, in the most preferred form of this embodiment 60, pad 11, 12 would have a thickness of about 0.04 inch (about 1 mm).

In either the first embodiment 10, or the second embodiment 60, of the present invention, pad 11, 12 could alternatively be attached to sole 16 or heel 17, respectively, by screws (not shown). Self-tapping screws could be used or, more preferably, tapped holes could be provided in sole 16 or heel 17, much as they are provided in known athletic shoes to accept cleats or spikes. Similarly, it would be within the scope of the present invention to attach pad 11, 12 to sole 16 or heel 17 with a detachable fastener such as a bayonet-type fastener (not shown) or a snap-type fastener (not shown) with appropriate sockets or slots provided in sole 16 or heel 17.

A third preferred embodiment of the present invention is shown in FIGS. 7–12. In this embodiment, shoe 70 is provided with a plurality of cleats 71, each of which has a plurality of miniature spikes 13. This embodiment is particularly well-suited for shoes 70 that are designed for traditional golf spikes. Such shoes are typically made with a plurality of threaded sockets 90, for receiving the threaded shafts of traditional golf spikes. Each cleat 71 is provided with a similar threaded shaft 91, attached to a flange 92 bearing a plurality of miniature spikes 13.

As in the first two preferred embodiments, cleat 71 preferably is made from a resilient polymeric material, most preferably polyurethane. The resilience of flange 92 allows it to deform when an obstruction is encountered, rather than serving as a lever arm for the removal of the cleat from the shoe. Cleat 71 will tend to stay in the shoe as it deforms, resuming its original shape when the obstruction is passed.

Figure 10:
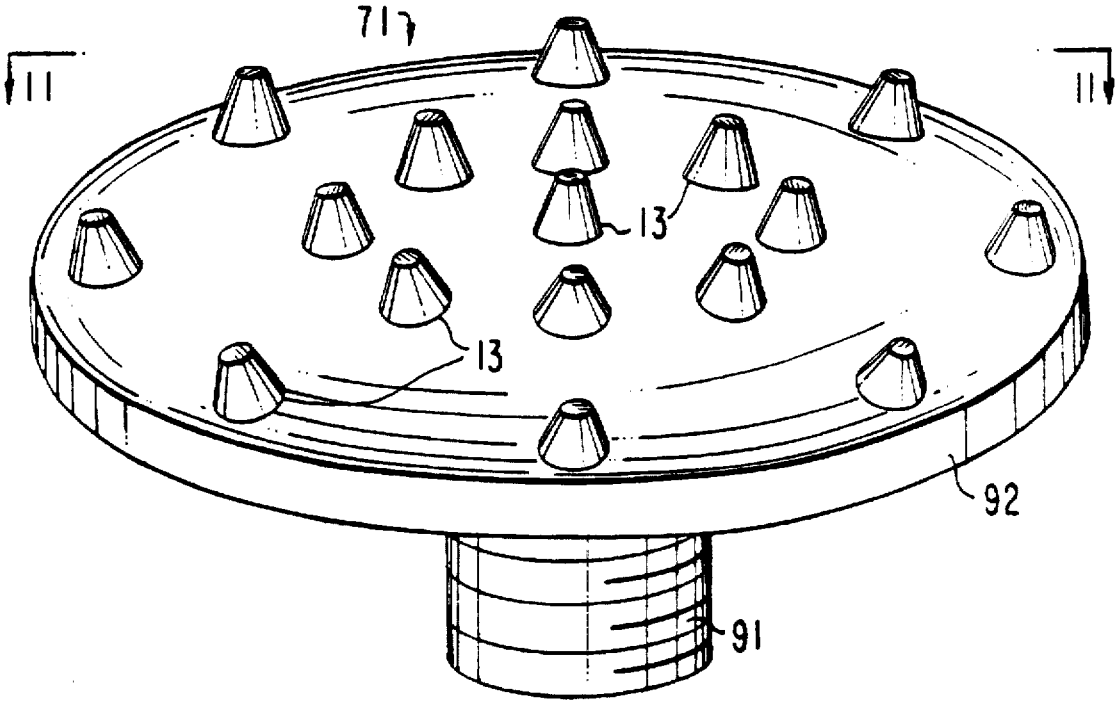
FIG. 10 is a perspective view of a preferred embodiment of a cleat according to the present invention.

The size and shape of miniature spikes 13 is preferably the same as in the first and second preferred embodiments as discussed above. Similarly, to minimize indentations, the thickness of flange 92 is preferably the same as that of pad 11, 12 in the second preferred embodiment. Some known golf shoes are provided with individual recesses (not shown) for the cleats 71, and on such shoes the thickness of flange 92 is less important. As seen in FIG. 10, flange 92 is slightly concave on the side facing sole 16 or heel 17. This provides a better seal between flange 92 and sole 16 or heel 17, preventing the entry of debris, and also provides tension to reduce the probability that cleat 71 will loosen and unthread from socket 90.

The spacing between miniature spikes 13 in the third preferred embodiment is also similar to that in the first and second preferred embodiments—i.e., the miniature spikes 13 should be far enough apart to prevent clogging. Preferably, the distance between miniature spikes 13 should be between about two and about four times the height of miniature spikes 13, more preferably about three times the height of miniature spikes 13. Thus, for miniature spikes 13 with a height of about 0.08 inch (about 2.0 mm), the distance between miniature spikes 13 preferably should be about 0.25 inch (about 6.35 mm).

Figure 11:
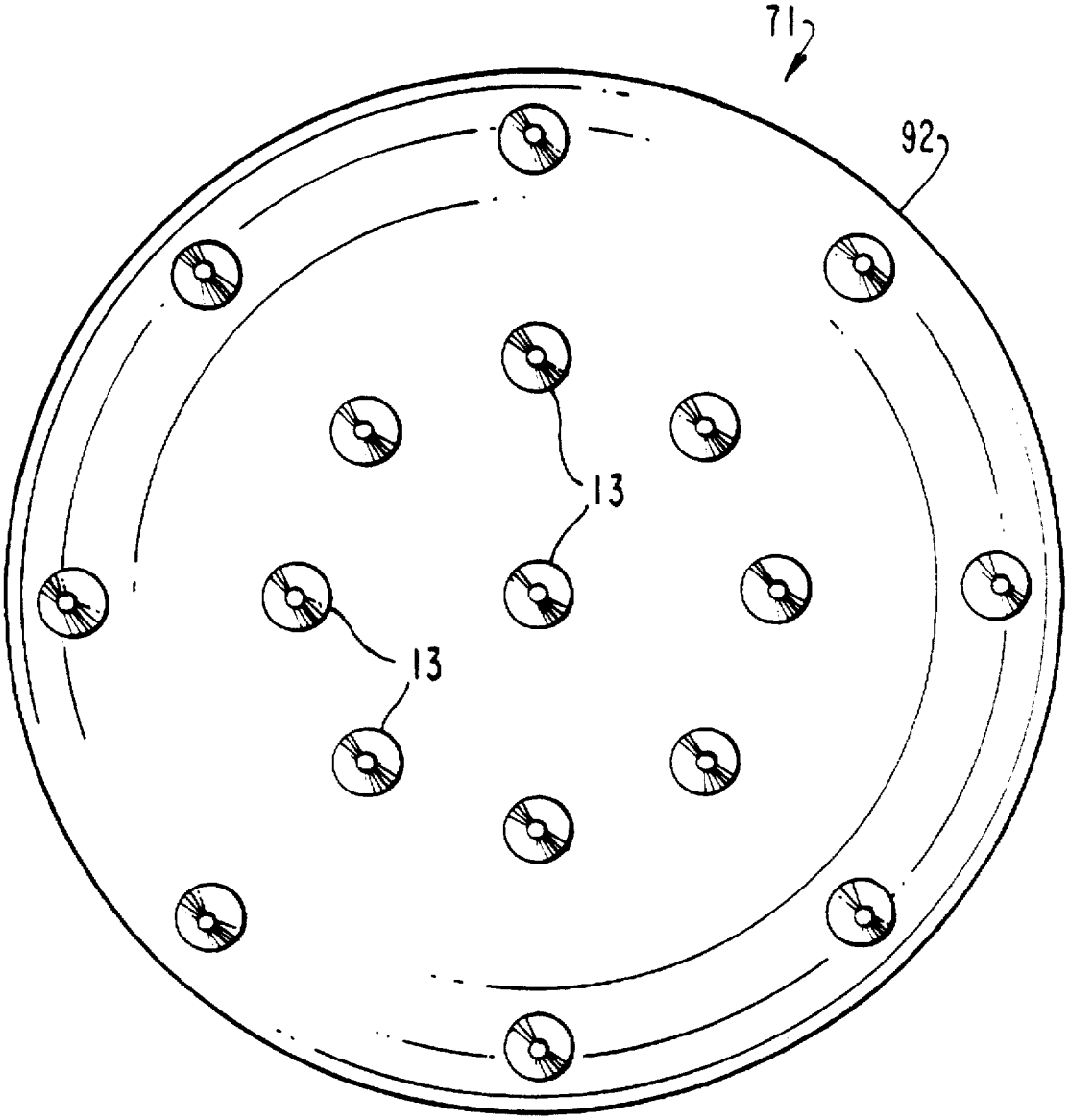
FIG. 11 is a plan view, taken from line 11—11 of FIG. 10, of the cleat of FIG. 10.

A first preferred arrangement of miniature spikes 13 on cleat 71 is shown in FIG. 11. A total of seventeen miniature spikes 13 are distributed in a circular area of preferably about 0.667 square inch (about 430 $mm^2$). The distribution is arranged to maximize the distance between miniature spikes 13 to achieve the desired separation discussed above. In the distribution shown, there is an outer ring of eight miniature spikes 13 around the edge of flange 92, an inner ring of eight miniature spikes 13 spaced inward from the first ring, and one central miniature spike 13.

Figure 12:
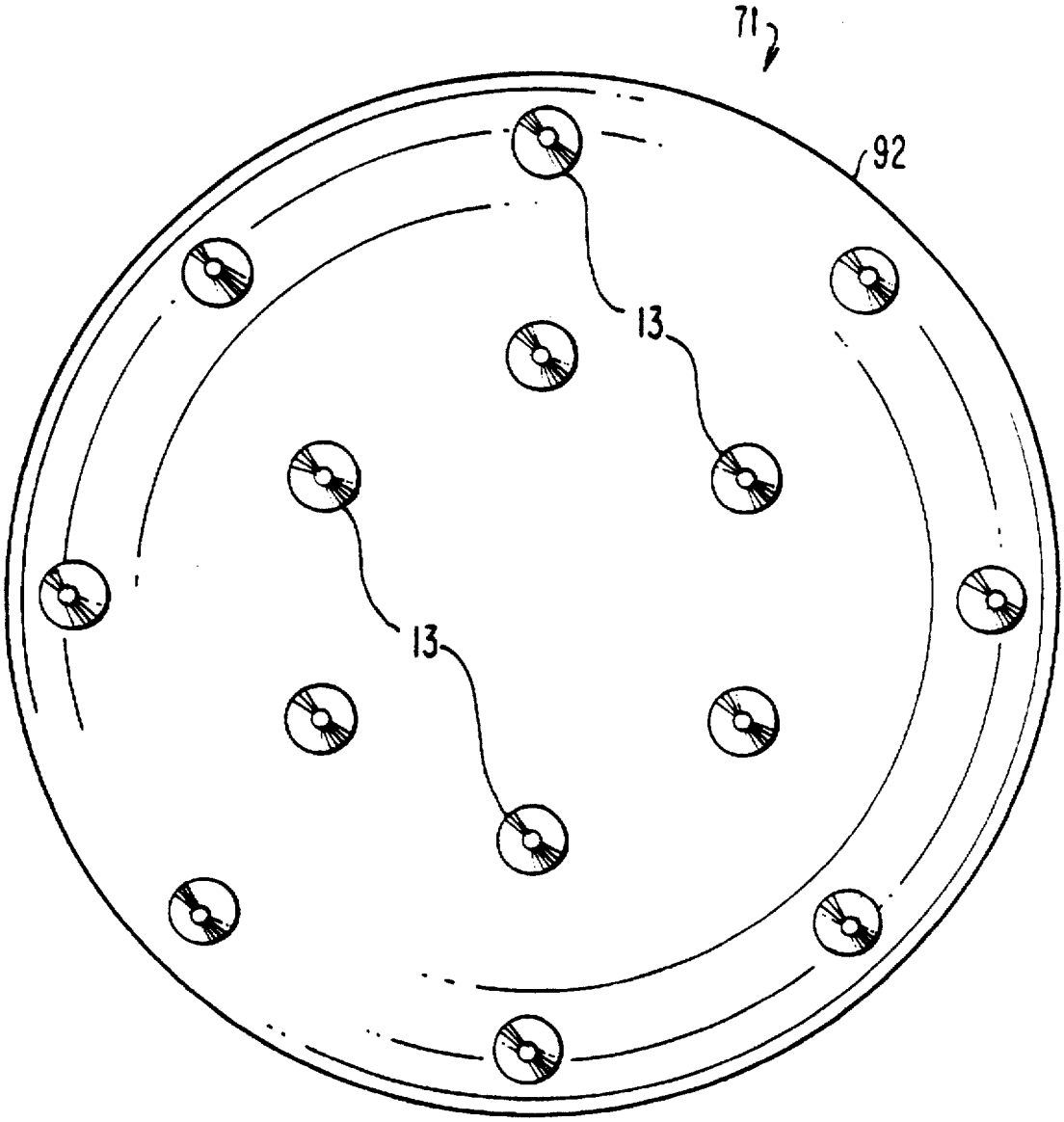
FIG. 12 is a plan view, similar to FIG. 11, of an alternative embodiment of a cleat according to the present invention.

A second preferred arrangement of miniature spikes 13 on cleat 71 is shown in FIG. 12. A total of fourteen miniature spikes 13 are distributed in a circular area of preferably about 0.667 square inch (about 430 $mm^2$). The distribution is again arranged to maximize the distance between miniature spikes 13 to achieve the desired separation discussed above. In the distribution shown, there is an outer ring of eight miniature spikes 13 around the edge of flange 92, and an inner ring of six miniature spikes 13 spaced inward from the first ring.

Thus it is seen that a system for providing traction in golf shoes (and shoes for other turf sports) that does not adversely affect turf, but provides a desired level of traction under as many different conditions as possible, is resistant to being dislodged from the shoe with which it is used, and is less damaging to pavement and flooring than previously known systems, has been provided.

What is claimed is:

1. An athletic shoe for providing traction on turf surfaces, said athletic shoe comprising:

a sole;

a heel;

at least one recess in (a) a significant area of said sole, or (b) a significant area of said heel;

a respective pad mounted in each said at least one recess by a hook-and-loop-type fastener; and a plurality of protrusions mounted on a surface of said respective pad; wherein:

each of said protrusions has a height between about 0.0625 inch and about 0.125 inch (between about 1.5875 mm and about 3.175 mm) to engage blades of grass in said turf to provide traction substantially without puncturing said turf;

said protrusions are spaced apart by a separation distance;

each said respective pad has at most about twenty-five of said protrusions per square inch (at most about 3.88 protrusions per square centimeter) to prevent clogging of space between said protrusions with debris from said turf;

each said respective pad has a pad thickness;

a hook portion of said hook-and-loop-type fastener is mounted on one of (a) said respective pad, or (b) said at least one recess;

a loop portion of said hook-and-loop-type fastener is mounted on another of (a) said respective pad, or (b) said at least one recess; and said at least one recess has a depth substantially equal to a combined height of said hook portion and said loop portion when fastened and said pad thickness, such that said respective pad surface is substantially flush with said sole or said heel.

2. An athletic shoe for providing traction on turf surfaces, said athletic shoe comprising:

a sole;

a heel;

at least one recess in (a) a significant area of said sole, or (b) a significant area of said heel;

a respective pad mounted in each said at least one recess by a releasable adhesive; and a plurality of protrusions mounted on a surface of said respective pad; wherein:

each of said protrusions has a height between about 0.0625 inch and about 0.125 inch (between about 1.5875 mm and about 3.175 mm) to engage blades of grass in said turf to provide traction substantially without puncturing said turf;

said protrusions are spaced apart by a separation distance;

each said respective pad has at most about twenty-five of said protrusions per square inch (at most about 3.88 protrusions per square centimeter) to prevent clogging of space between said protrusions with debris from said turf; and said at least one recess has a depth selected such that said respective pad surface is substantially flush with said sole or said heel.

* * * * *

UNITED STATES PATENT AND TRADEMARK OFFICE

CERTIFICATE OF CORRECTION

PATENT NO : 5,761,833

DATED : June 9, 1998

INVENTOR(S) : Faris W. McMullin

Figure 7:
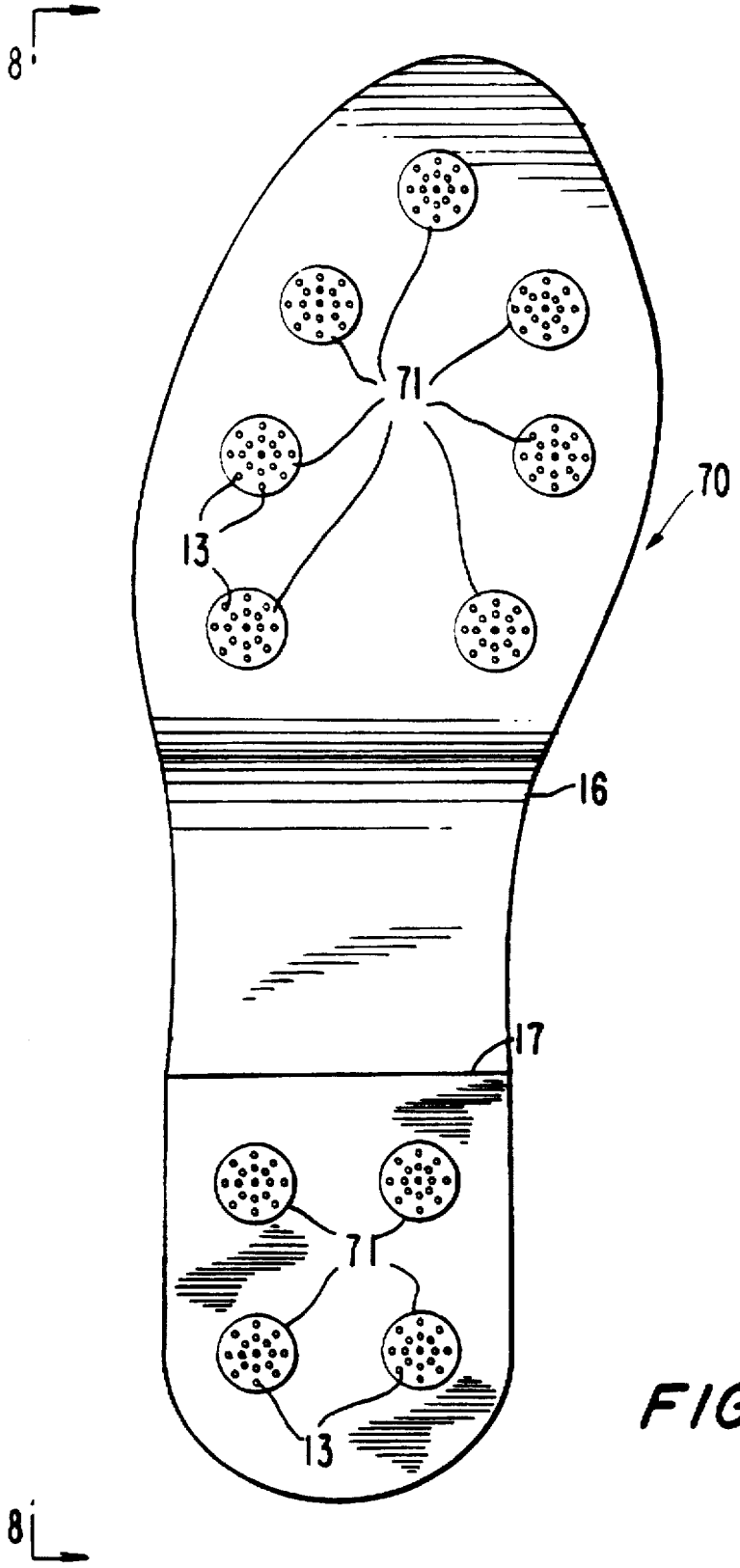
FIG. 7 is a plan view of the bottom of an athletic shoe incorporating a third preferred embodiment of the present invention.
Figure 8:
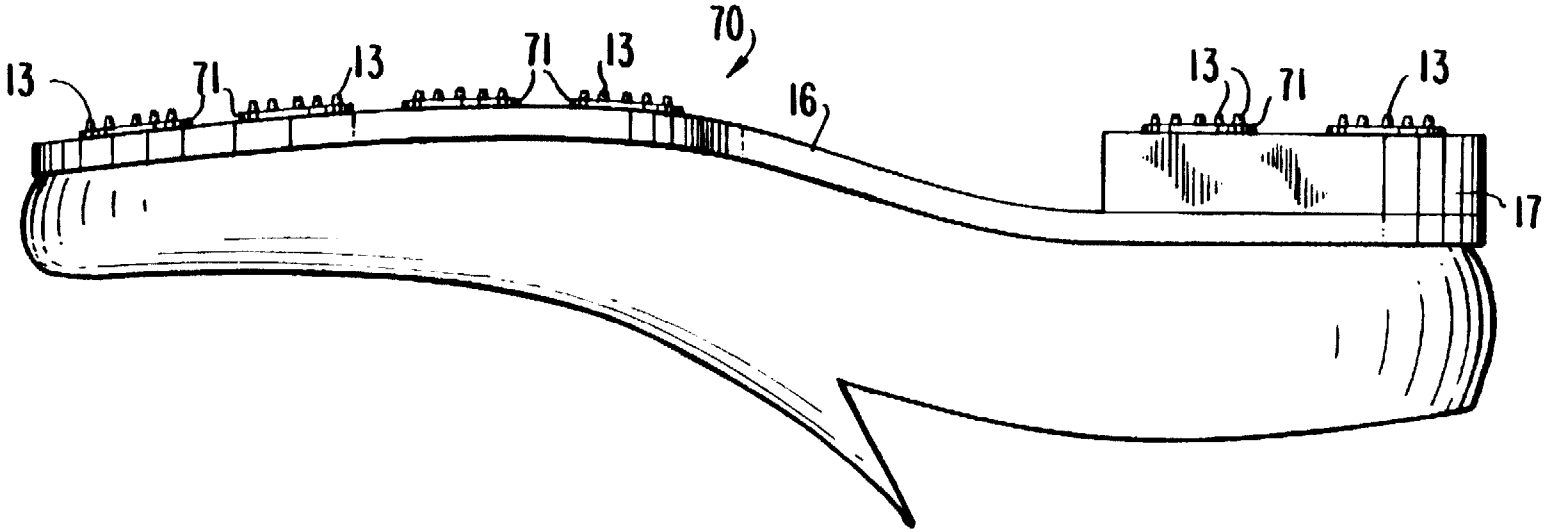
FIG. 8 is a side elevational view, taken from line 8—8 of FIG. 7 of the athletic shoe of FIG. 7.
Figure 9:
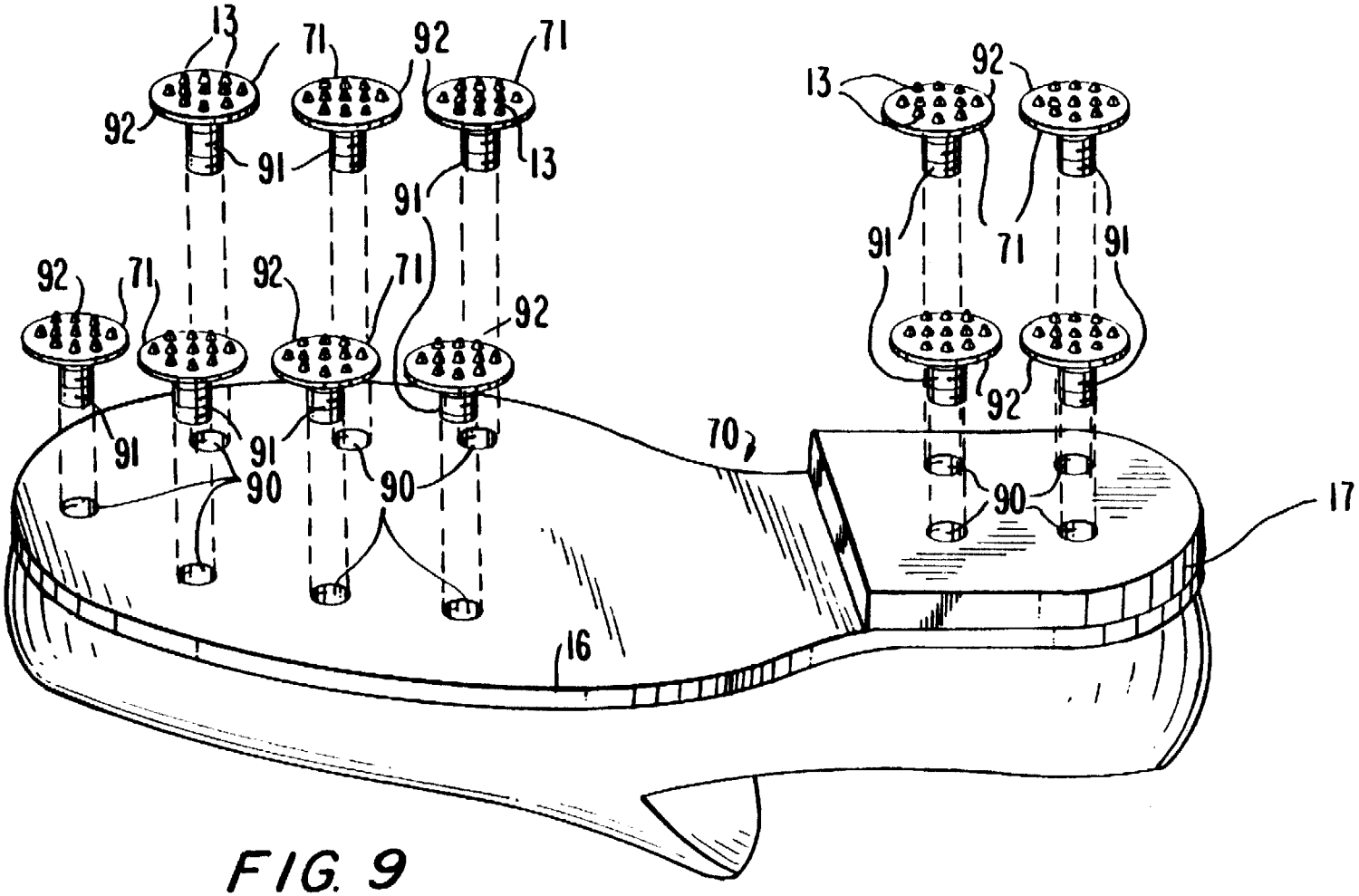
FIG. 9 is an exploded perspective view of the athletic shoe of FIGS. 7 and 8.

It is certified that error appears in the above-identified patent and that said Letters Patent is hereby corrected as shown below:

Column 3, line 22, "FIG. 7" (first occurrence) should be -- FIG. 7,--.

Column 5, line 67, "cleats-are" should be -- cleats are --.

Column 6, line 17, "heat-and" should be -- heat- and --.

Signed and Sealed this

Twentieth Day of June, 2000

*Attest:*

Q. TODD DICKINSON

*Attesting Officer*

*Director of Patents and Trademarks*